US005426838A

United States Patent [19]

Korb

[11] Patent Number: 5,426,838

[45] Date of Patent: Jun. 27, 1995

[54] METHOD AND MEANS FOR APPLYING VENTS TO FABRIC

[76] Inventor: Lothar Korb, 22 Burningham Cr., Ajax, Ontario, Canada, L1S 6A2

[21] Appl. No.: 228,875

[22] Filed: Apr. 18, 1994

[51] Int. Cl.[6] ..... B23P 19/00; A41H 37/02

[52] U.S. Cl. ..... 29/33 R; 29/243.517; 227/18

[58] Field of Search ..... 29/33 R, 243.517, 243.56, 29/243.53, 243.518, 243.522; 227/18, 41, 48, 144, 109, 156

[56] References Cited

U.S. PATENT DOCUMENTS

| | | | |
|---|---|---|---|
| 867,516 | 10/1907 | Lause et al. | 227/18 |
| 1,388,862 | 8/1921 | Horgan | 227/18 |
| 1,423,623 | 7/1922 | Shaw | 237/18 |
| 2,087,969 | 7/1937 | Gookin | 29/243.517 |
| 2,456,433 | 1/1948 | Lofgreen | 227/18 |
| 4,694,984 | 9/1987 | Altwicker | 29/243.53 |
| 4,799,611 | 1/1989 | Taga | 227/18 |
| 5,339,984 | 8/1994 | Schmidt et al. | 29/243.56 X |

FOREIGN PATENT DOCUMENTS

| | | | |
|---|---|---|---|
| 3633539 | 4/1988 | Germany | 227/144 |
| 927064 | 5/1963 | United Kingdom | 227/18 |

*Primary Examiner*—William Briggs

[57] ABSTRACT

A vent applicator positions, a skirted vent blank on one side of a fabric and a die on the other, and impels the blank downwardly through the fabric so that the skirt is curled up and out by the die to clamp the fabric to the blank. To position the vent blank, it is suspended on deflectable fingers which are deflected when the blank is impelled downwardly. Preferably a hole is punched in the fabric before the die is moved downwardly. Sensors detect the presence of a vent blank ready for downward movement. A washer may be positioned over the die for clamping between the upturned skirt and the fabric. If a washer is used sensors detect the presence and positioning of a washer.

21 Claims, 11 Drawing Sheets

10
12
14
16
20
28
40
32
42
44
34
36
LM
RM
48
52
72
56
122
136
128
30
64
50
62
61
22
38
37
11

52
46
44
70
38,22
30
38
10
14
24

METHOD AND MEANS FOR APPLYING VENTS TO FABRIC

This invention relates to means and a method for applying a vent to a fabric. Commonly the fabric is a mattress border.

'Horizontal' herein is the plane of the fabric at the point of application of the vent. Thus the vent blank is spoken of as being applied transverse to the fabric and 'downwardly' to the fabric. These terms are used for ease of description only and the mutually perpendicular horizontal and vertical directions, may, in fact, be otherwise oriented within the scope of the invention.

The vent is formed from a vent blank which is provided with a flange surrounding the vent aperture and designed to be horizontally oriented over the fabric and provided with a skirt which is shaped to initially extend downwardly, and to be moved downwardly through a hole punched in the fabric. Preferably the hole is punched first before the descent of the skirt. However it is within the scope of the invention to allow the descending skirt edge to punch its own hole. The lower edge of the skirt is then forced downwardly into the groove of a shaping die which rolls the lower edge of the skirt outwardly, then upwardly to clamp the fabric to the lower surface of the flange. A backing washer is thought, by some, to be desireable and in this case vent blank skirt, in rolling upwards clamps the washer against the fabric and latter against the vent flange.

The inventive apparatus and its operation will be described in general terms.

1. Initially: A fabric is located over a horizontal support surface (table) which surface is apertured to provide an apertures, allowing downward entrance to a die for receiving the lower edge of the skirt to curl upwardly the skirt of a descending vent blank.

Above the fabric is a vent support block in an upper position with downwardly deflectable fingers for supporting the flange of a vent blank, with the blank's skirt extending downwardly.

Above the vent support is a pusher rod which preferably includes both a vertically oriented sleeve and a coaxial central punch rod. The pusher rod or sleeve may pass vertically through the vent guide block by downwardly deflecting the fingers.

When the sleeve and punch rod are used, the die is provided with a central bore to receive the punch rod. The die is provided with an upwardly facing annular groove about the bore to shape a descending vent skirt edge into clamping position. (If a hole is to be punched for the vent blank, start at 2 below, and if not, start at 5).

2. The sleeve is then lowered to clamp the fabric.

3. When a sleeve and punch rod are used, the sleeve is lowered, deflecting the vent blank fingers, to clamp the fabric to the table. The punch rod then extends from the sleeve and punches a hole in the fabric to allow (later) downward travel of the vent blank skirt. For such hole to be punched, cooperating edges on the punch rod and the die bore cause shearing of the fabric.

4. The punch rod is then retracted into the sleeve so that their lower surfaces are flush in the rod's retracted position.

5. The sleeve and rod, on the one hand, and the vent block on the other, both move to their upper positions, with the sleeve above the block.

6. In the vent block's upper position, it is positioned to receive and at this time does receive a vent blank to be supported by its flange in horizontal attitude on the deflectable fingers and with the skirt extending downwardly between the fingers. If a support washer is to be used it is positioned, at this time, between the die and the fabric.

7. Preferably, a sensor determines whether the blank is correctly positioned on the fingers or not. If so the sensor will be designed to send a signal to a controller that the operation may proceed or that it may not.

Preferably a sensor is provide to determine whether the washer is correctly positioned over the die or not. If so the sensor will be designed to send a signal to the controller that the operation may proceed or not.

Sensors, as described in the two preceding paragraphs aid in the automation of the machines described.

8. With the vent blank and, if used, the washer, in place, the sleeve descends to deflect the fingers and to push the vent blank downwardly into the die groove. The lower edges of the blank skirt contact the die groove, having passed through the hole and the aperture in the washer, if the latter is used. After contacting the die groove the skirt is curled outwardly and upwardly by the shaping die to clamp the washer, if used, and, in either event, the fabric against the vent flange. The vent is now installed.

9. The sleeve and the vent guide block are then returned to their original positions.

10. The fabric will then be re-positioned for application of vents in new locations. This is the last step of a cycle.

It is within the scope of the invention to eliminate the initial hole punching step (see 3 above). If no hole is initially punched then the vent blank skirt punches its own hole as it descends to crimp the fabric. In such case no punch rod will be required and a unitary pusher rod may replace the sleeve and punch rod. This is a less preferred mode of operation than the preferred method and detaches a circle of skirt-punched fabric which may block the vent holes.

There is thus provided an effective and efficient means and method of installing vents on fabric. It has a number of features which distinguish from the prior art as I know it. A particular advantage is that the means and method lend themselves to automatic operation. Particular advantages of a preferred aspect of the invention are the design of the sensing means for the presence of the vent blank, and the design of the sensing means for the presence of the washer, if used.

A further feature of such preferred aspects of the invention, is the fact that the use of the sensory means assists in the automation of the process.

Other features and advantages will be obvious from the description of the specific embodiment to follow.

In drawings which illustrate a preferred embodiment of the invention:

(In the drawings 'left hand side' and 'right hand side' are frequently abbreviated to 'LHS' and 'RHS', respectively)

FIG. 1 is a perspective view of 2 vent application mechanisms. On the LHS the vent 1 is lowered to the vicinity of the fabric on the table. On the RHS the vent block is raised (and the drawing is broken away to show a washer positioning apparatus).

FIG. 1*a* is a perspective view of a vent blank and a washer.

FIGS. 15-1 to 15-8 show the operation of the preferred embodiment.

In some of the drawings it will be noted that two vent blank applying machines are sometimes shown. Although the invention is totally embodied in a single machine, it is common to use two machines side-by-side. Moreover, the illustration of side-by side machines allows illustration of such a machine two positions.

Figures 1, 1A:
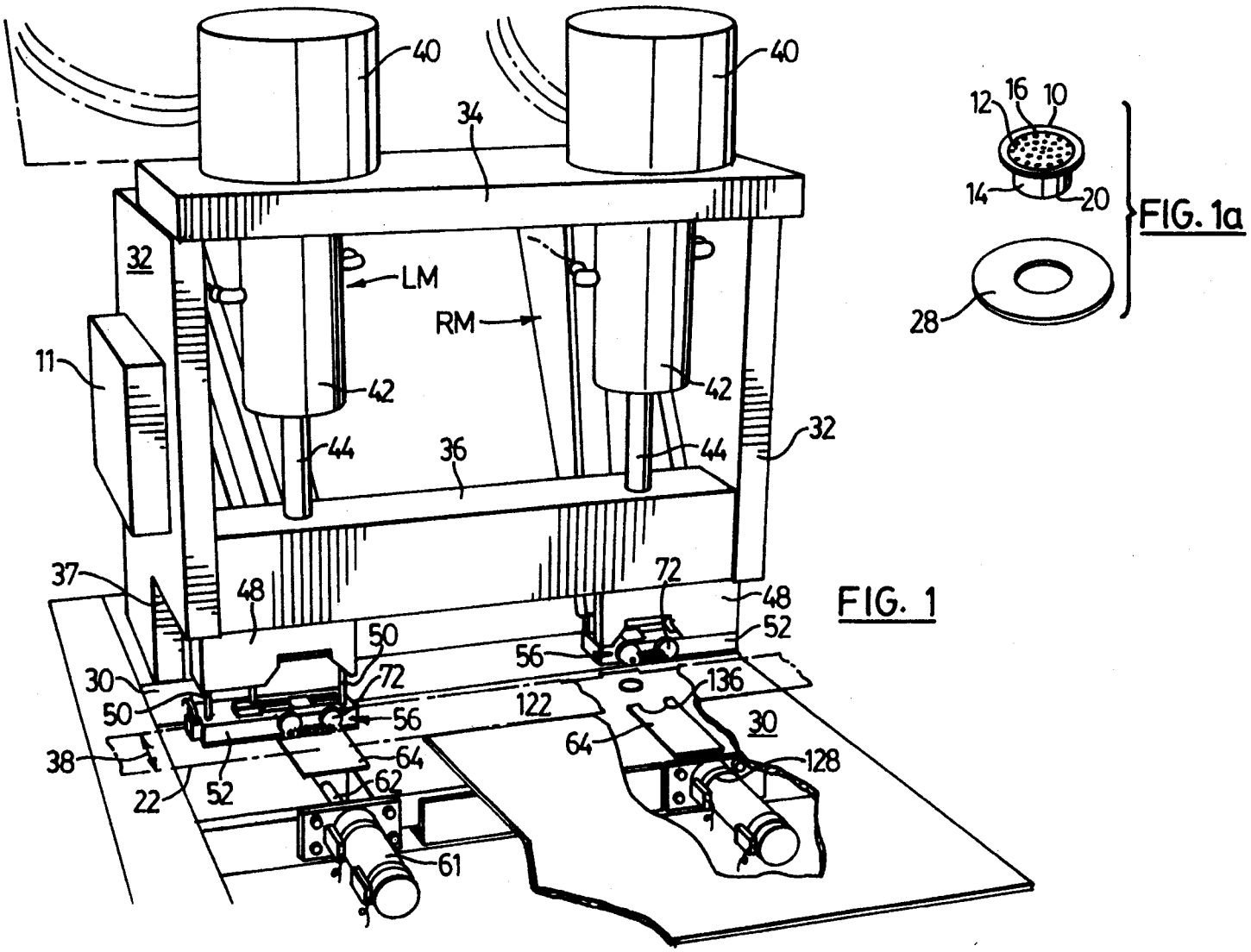

In the drawings, FIG. 1*a* shows a skirt blank in accord with the invention. A flange 10 surrounds a central area 12 having a number of small air passages 16. A skirt 14 extends downwardly from flan&e 14 outwardly of area 12 and inwardly of the flange edges, to a lower skirt edge 20. As FIG. 6 demonstrates in section, in the final result the flange 10 overlies the fabric 22, while the skirt 14 extends downwardly through a hole in the fabric (slightly deflecting the fabric edges) or cutting as mall ring of fabric to increase the hole size; and its lower edge 20 contacts a groove 24 in a die 26 to be curled upwardly and outwardly to clamp the fabric 22 to the lower side of the flange 10.

If a backing washer 28 is used, it overlies die 26, the skirt 14 extends downwardly through the washer aperture and is curled up to clamp the washer, and, through the washer, the fabric 22, against vent flange 10.

One of the important advantages of machines in accord with the invention is that the components and their mode of operation lend themselves to automation. This application does not claim an automated machine but rather claims the features which lend themselves to automation. As an aid to disclosure a controller 11 is schematically shown in FIG. 1. This may schematically represent a number of controllers or processing components. It will be understood that, except where specifically addressed herein (for the sensing of vent blank attitude and washer presence), it is understood that conventional means are available, well known to those skilled in the art, for signalling to the controller the current position and status of the various operating components, and for the controller to cause, as a result of such status, the next step in the process.

Dealing with the machine construction, FIG. 1 shows a table with upper surface 30 for supporting the fabric 22. Rigidly attached to the table are the side members 32 of a frame which includes upper and lower cross members 34 and 36. The side members 32 are recessed at their front and lower ends to provide an overhang 37 which corresponds to point of attachment of the lower cross member 36 overlies the path 38 of the fabric 22 which receives the vents. (Although not shown, the fabric 22 will frequently be much wider than strip 38). The cross members support the machines for applying the vent blank to the fabric as hereinafter described.

Mounted on upper cross member 34 are right and left air cylinders 40 each of which control the height of a further air cylinder 42. Sleeve 44 moves with cylinder 42 under control of cylinder 40. A punch rod 46 (FIG. 3) is contained in sleeve 44 to move vertically relative thereto between retracted and extended position under the control of cylinder 42. In retracted position the lower surface of punch rod 46 is flush with that of sleeve 44.

Mounted on the lower side of cross member 36 is vent positioner mount 48. Three vertical support rods 50 are extendable and retractable relative to mount 48 to control the vertical location of vent support block 52. The vent positioner block 52 mounts a vent positioner assembly 56 which will be described in detail hereafter.

Where a washer 28 is to be used, the table 30 is recessed below surface 30 to mount the piston 61 with piston rod 62 which mounts the thin pusher plate 64 which slides on surface 30 and which is shaped to position washer 28 (as hereinafter described) into operative position above die 26 (see FIGS. 10–13).

Figure 4:
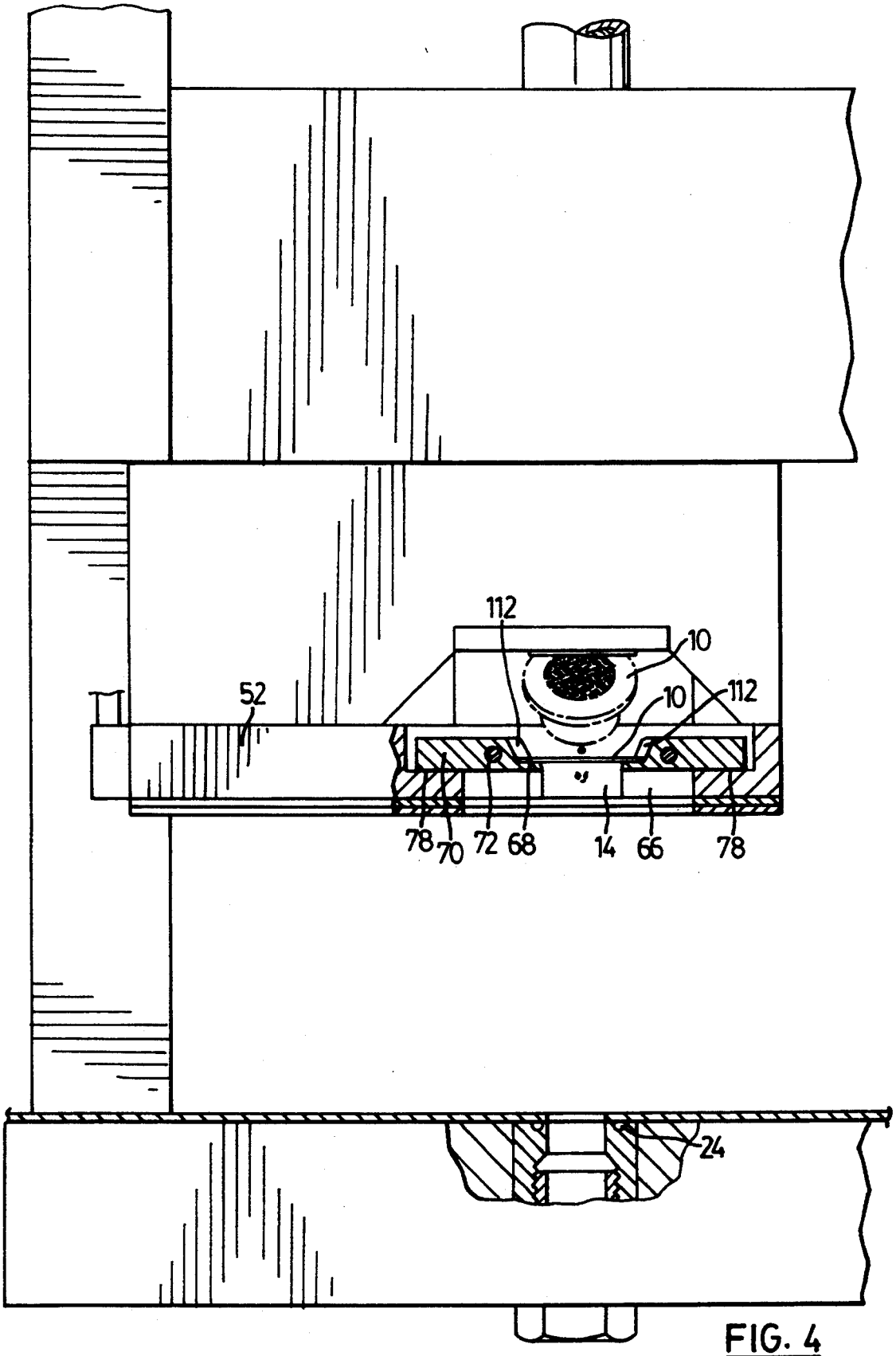
FIG. 4 is a view similar to FIG. 3 but having the sleeve retracted to upper position, the vent block in upper position, and showing a vent blank supplied to the block fingers, and the means of supply.

Vent support block 52 is apertured at 66 (FIGS. 4, 5 and 6) to allow downward passage of vent flange 10 with the skirt 14 extending downwardly therefrom. As shown in FIG. 4 the vent blank may be suspended with its flange 10 resting on the pads 68 (FIG. 4) of deflectable fingers 70 which pivot with shafts 72 relative to the block 52. Shafts 72 extend forwardly out of the block to mount wheels 74 fixed thereto (FIG. 2) which each eccentrically mount one end of a connecting tension spring 76 which biases the fingers against stop surfaces 78 (FIG. 4).

FIG. 1 shows the vent mounting block 52 of the left hand machine LM in a downward position.

The left and right hand machines LM and RM have similar construction and modes of operation.

Figure 2:
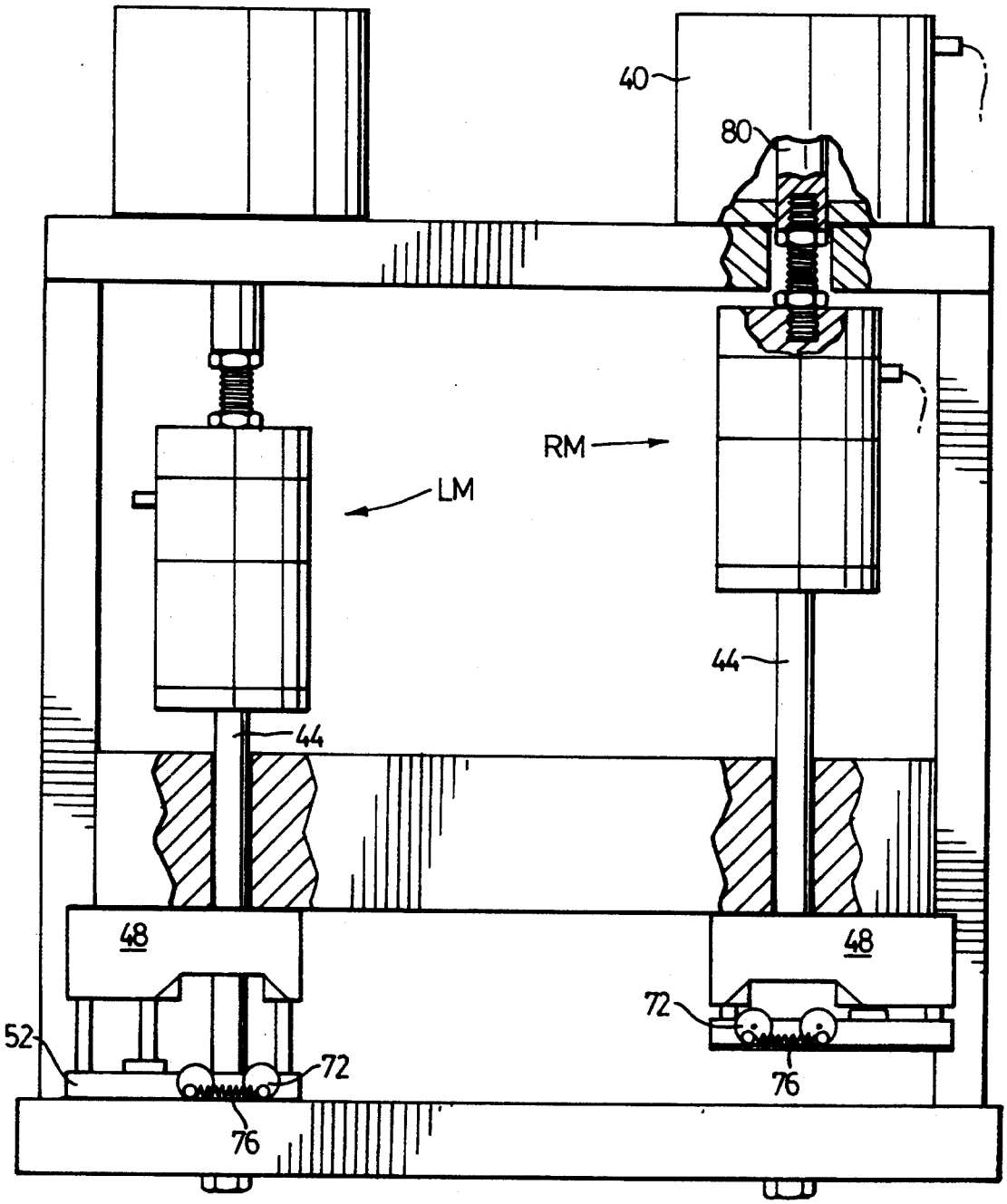
FIG. 2 is a simplified front elevation of two vent block operating assemblies, one in the raised and one in the lowered position on the RHS and LHS, respectively.

FIG. 2 shows a broken away portion in right hand machine RM to demonstrate that upper cylinder 40 operates a piston rod 80 to control the height of cylinder 42 and with it the height of sleeve 44. Thus in FIG. 2 the machine LM shows the cylinder 42 and sleeve 44 in lower position where the sleeve is just above the fingers 70 (as in FIG. 3) while the machine RM shows the cylinder 42 and sleeve 44 in upper position (as in FIG. 1). FIG. 2 also shows machine RM with the vent block 52 in upper position and machine LM with the vent block 52 in lower position.

Figure 3:
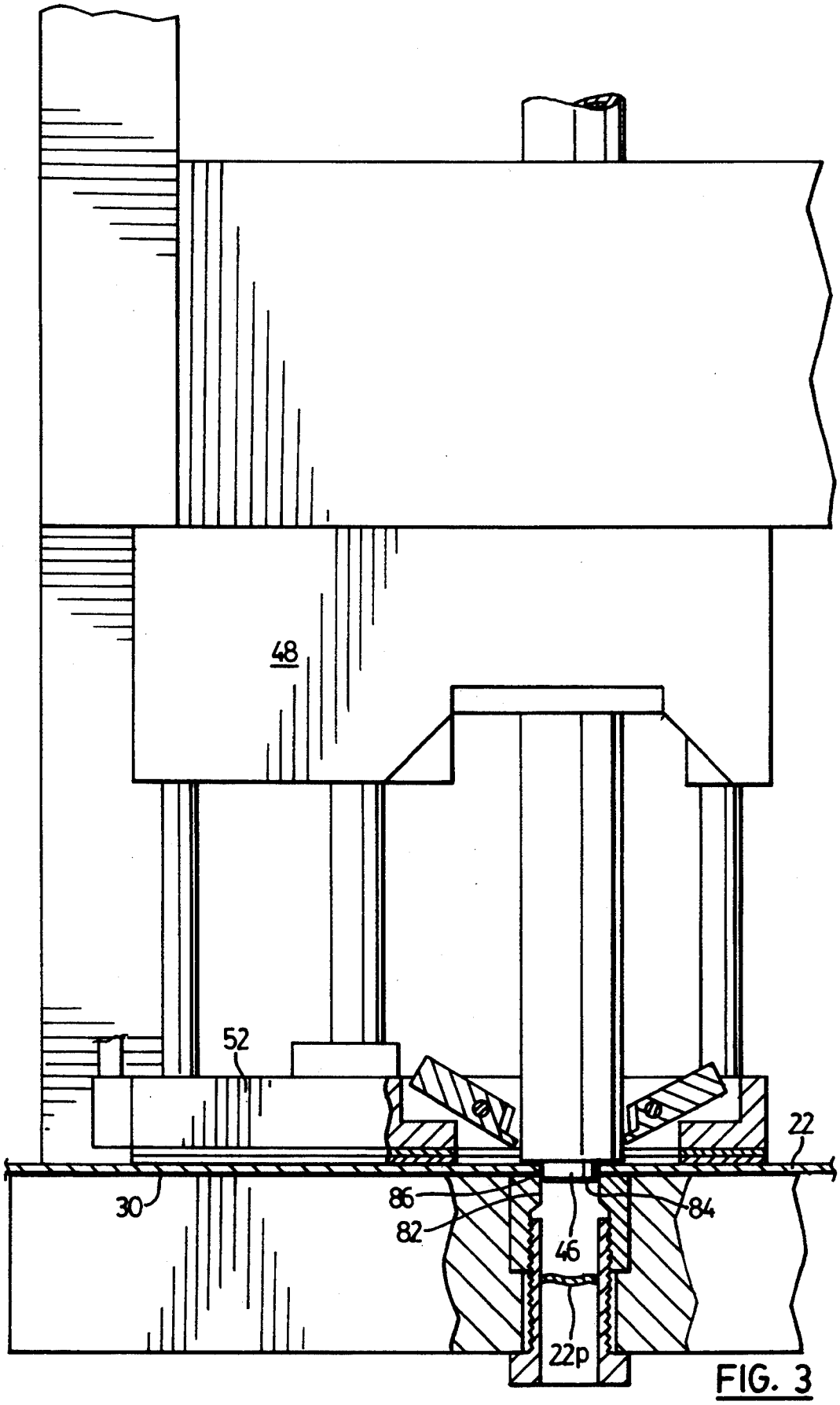
FIG. 3 is an enlarged scrap detail, partly in section, showing a sleeve in its lower position clamping the fabric, and the punch rod in a lower position and having just removed a portion of the fabric.

FIG. 3 shows the sleeve 44 in lower position, clamping the fabric 22 against table surface 30. The vent block 52 is in lower position. Cylinder 42 has been operated to cause punch rod 46 to move below its retracted (relative to the sleeve) position to enter the bore 82 in die 26. In so doing the punch rod has punched the fabric paricle 22P out of fabric 22 to provide the aperture in the fabric for downward travel of the vent skirt 14. It should be noted that the edges 84 of punch rod 22 and edge 86 of die 26 at the entrance to bore 82 must be carefully shaped, and relatively dimensioned to cleanly shear the fabric on descent of the punch rod 82.

FIG. 4 shows a vent blank with its flange 10 resting on finger pads 68 and skirt 14 extending downwardly between the fingers 70. FIG. 4 shows, in dotted form, the next vent blank for deposit on the fingers as hereinafter described. The method of supplying and metering vent blanks is discussed in relation to FIGS. 14*a* to 14*d*.

Figure 5:
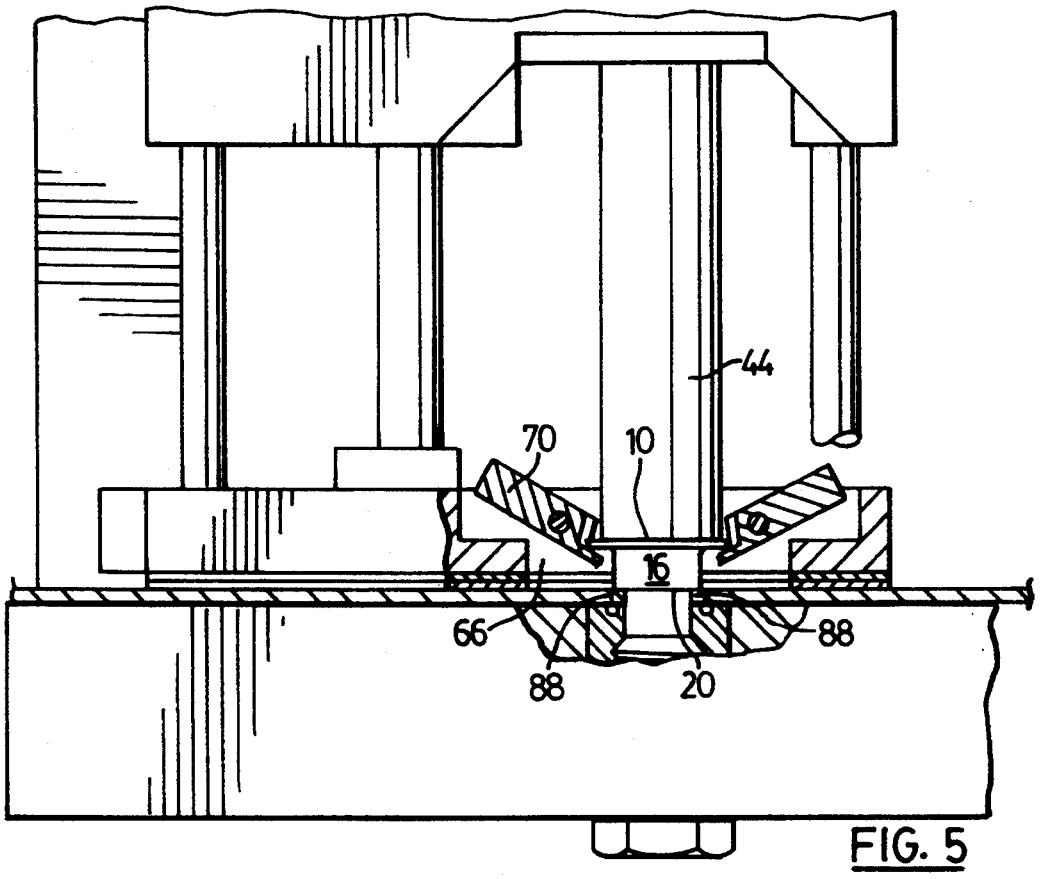
FIG. 5 shows the sleeve and retracted punch rod descending and moving downwardly the vent blank.
Figure 6:
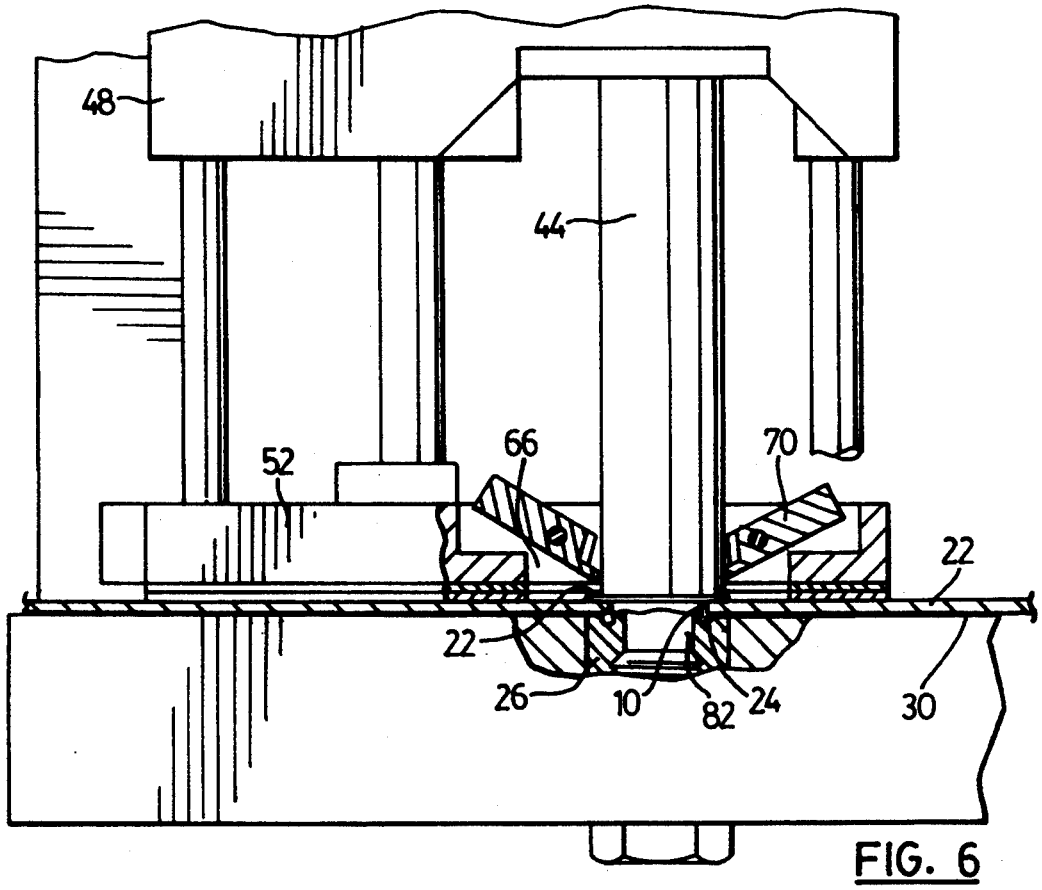
FIG. 6 shows the sleeve and retracted punch rod pushing the vent blank downwardly so that the lower edges of skirt are curled upwardly to clamp the fabric against the skirt flange.

FIGS. 5 and 6 show the descent of the sleeve 44 from the upper position to the lower. (The punch rod 46 is not visible in FIG. 5 and 6 since its lower surface is level with that of sleeve 44).

As shown in FIG. 5 the sleeve has descended from position to contact the upper surface of the vent blank and push it downwardly)deflecting fingers 70 against the bias of springs 76. In descending, the skirt edge 20 deflects and brushes aside the inward edge 88 of the fabric about the aperture and this may be done sufficiently for the edge 20 to pass through the hole punched by punch rod 46 and enter shaping groove 24, or in some cases the vent may cut a ring of fabric to enlarge the hole.

Figure 6A:
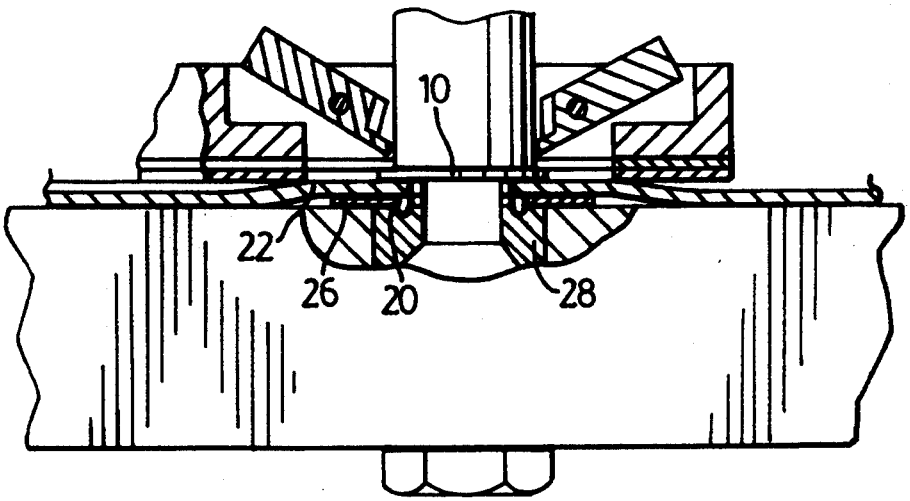
FIG. 6A shows a scrap view, similar to FIG. 6 illustrating clamping by the vent skirt when a washer is used.

The shaping groove 24 is formed as an annulus about bore 82 and groove 24 is shaped, in radial section to curl the skirt edge 20 and the adjacent portion of skirt 14 outwardly and upwardly to clamp the fabric against the flange 10. FIG. 6 therefore shows the vent clamped in place. No washer is used in FIG. 6. FIG. 6A shows the vent with washer and fabric clamped by edge 20 when a washer is used.

Figure 7:
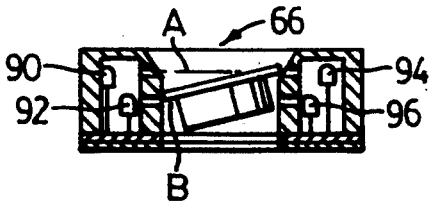
FIG. 7 is a vertical cross section along the lines 7—7 of FIG. 1 through the finger base assembly, showing the sensors and a mis-aligned vent blank.
Figure 8:
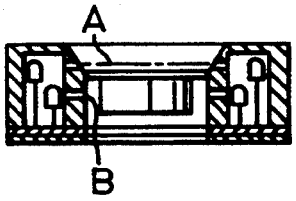
FIG. 8 shows the same section as FIG. 7 but with a properly aligned vent blank.
Figure 9:
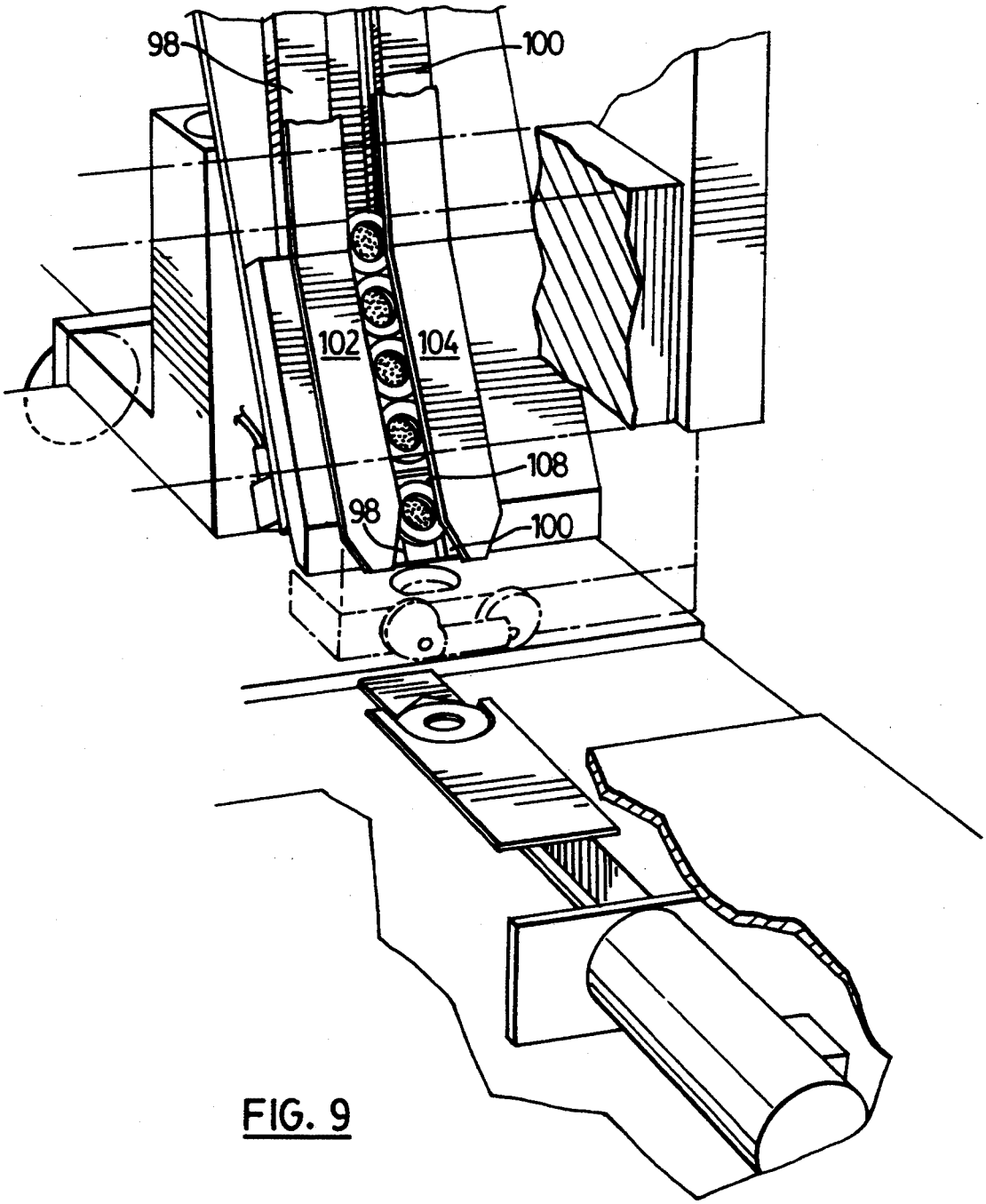
FIG. 9 is a scrap perspective view showing, with the frame and finger base assembly broken away for clarity, the vent blank chute and the vent blank metering assembly.
Figure 10:
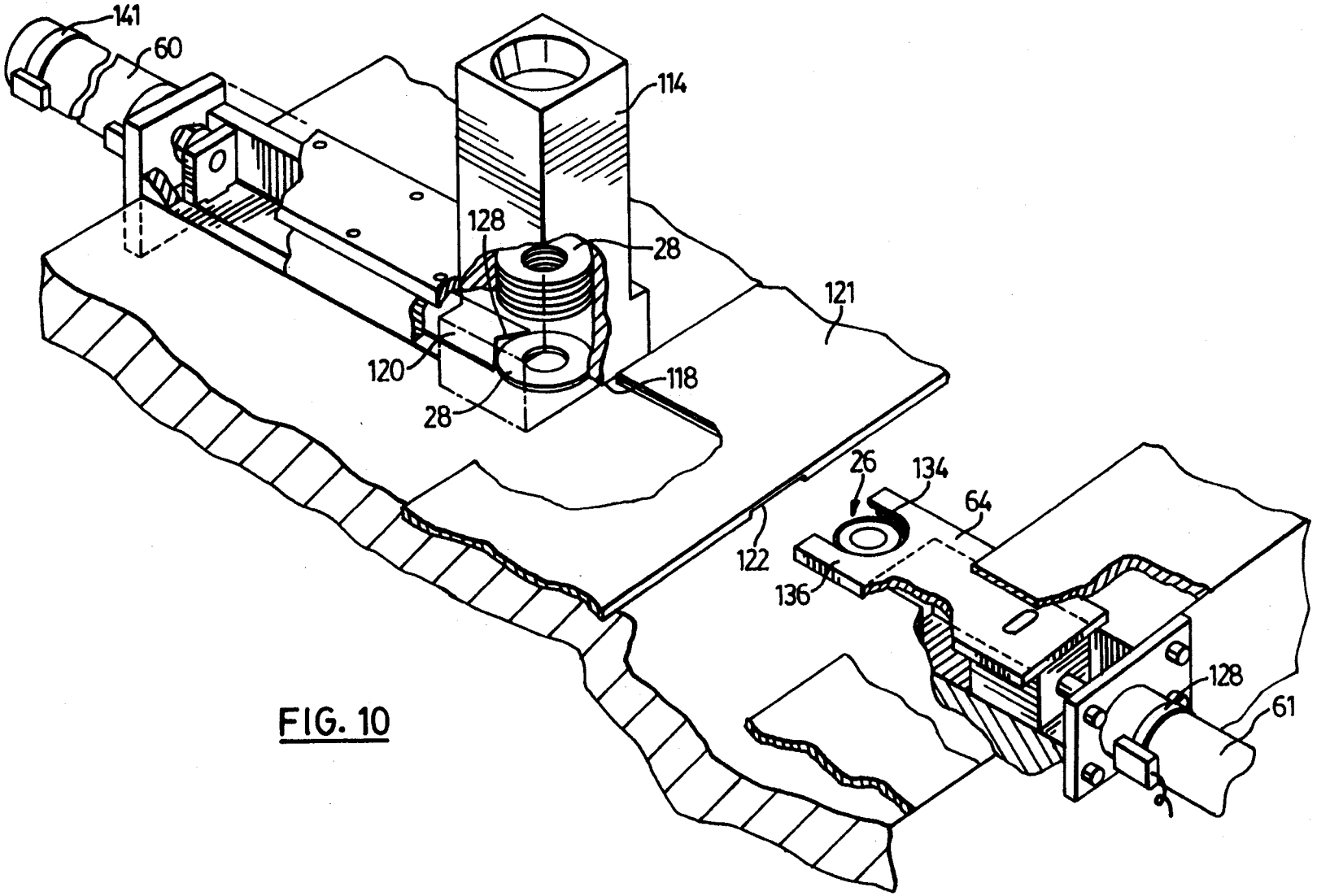
FIG. 10 is a perspective, partially exploded view showing the backing washer installation means and the means for washer position sensing.

FIGS. 7 and 8 are vertical sections taken through the vent block assembly and aperture 66, along the line 7—7 of FIG. 1. FIGS. 7 & 8 each show light beam emitters 90 and 92 and light sensors 94 and 96. The emitter-sensor combination 90-94 defines a horizontal path 'A' just above the vent flange 10 when correctly positioned as shown in FIG. 8. The emitter sensor combination 92-96 defines a horizontal path 'B' which will intercept the skirt of a vent blank which is resting on the fingers 70 (whether in correct orientation, or not).

FIG. 7 shows that, with an incorrectly positioned vent blank, path 'B' will be interrupted so that sensor 96 detects the presence of a vent blank. However, path 'A' will also be interrupted so that the sensor 94 detects the incorrect positioning of the blank. Thus the controller 11 receiving the signal from the sensor, by connections not shown, will not permit the downward movement of the sleeve from its upper position.

As shown in FIG. 8, with a correctly positioned vent blank, path 'B' again is blocked signalling at sensor 96 the presence of a blank. Path 'A' is not blocked and the light detected by sensor 94 indicates that the vent blank is correctly positioned. The signal from sensors 94, 96 now indicates to the controller that a vent block is correctly positioned on fingers 70 so that the controller may initiate the descent of the sleeve 44 to lower position as shown in FIGS. 5 and 6.

FIGS. 9 and 14*a*–14*d* show the method of feeding the vent blanks. A chute is defined by lower spaced plates 98-100 and upper spaced plates 102-104. The facing edges of plates 98-100, receive between them, and guide, the skirts 14 of a series of blanks which have been placed in the chute in any desired manner. The spaced pairs of plates on each side of the chute: 98-102 on one side, and 100-104 on the other, slidably receive the vent blank flange 10 between then and maintain the correct orientation of the vent blanks until they are released onto the fingers. Members spacing plates 98-102 and 100-104 define inwardly facing edges 103-105 which guide the edges of skirt 10 during interruption of the inner edges of plates 98-100 at block 108. FIGS. 14*a*–14*d* show the metering device for releasing the vent blanks, one at a time, onto fingers 70. The slide block 108 is located to slide transversely in an slot in plates 98-100 just above the lower end of the chute and is reciprocated, by means not shown, under the control of controller 11. Slide 108 defines slot 110 of a width to slidably receive skirts 14 and which is angled across block 108 for a distance equal to the reciprocal travel of block 108. It will be noted that angled slot 110 has short vertical ends 109 and 111 to assist the travel of the blank into and out of slot 110.

Figure 14A:
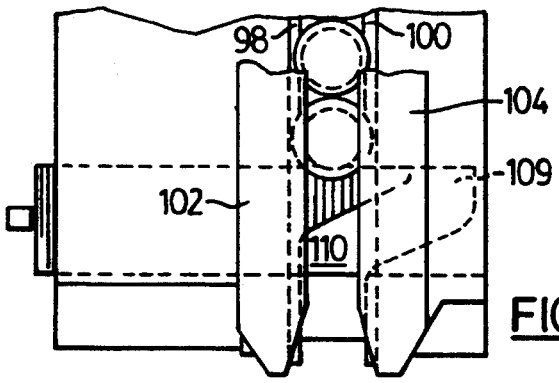
FIGS. 14*a*–14*d* are vertical sections showing the operation of the vent blank metering means.

FIG. 14*a* shows the block 108 at its right hand limit of travel and slot 110 is not accessible to the skirt of the lowermost vent blank in the chute above. In this position a vent blank is just falling out of the lower end of slot 108, and of the chute, onto the fingers 70. (See FIG. 9, and note that a chute is located behind each machine LM and RM in FIG. 1 and the height of the chute exit is to feed a vent blank onto the fingers 70 when the vent block is in its upper position as in machine RM of FIG. 1).

Figure 14B:
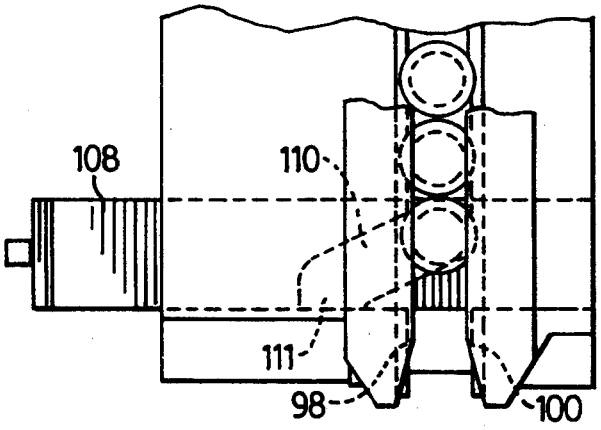
Figure 14C:
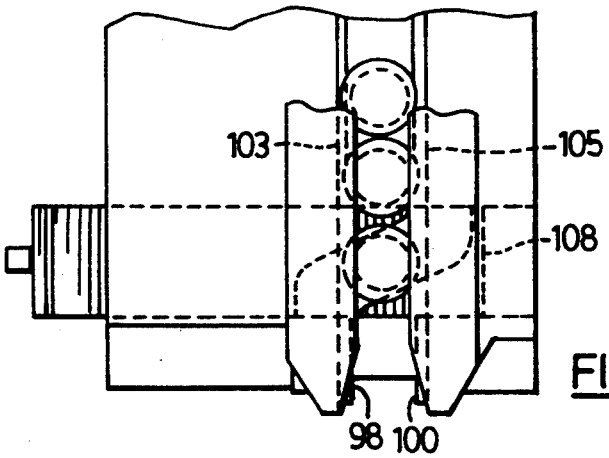
Figure 14D:
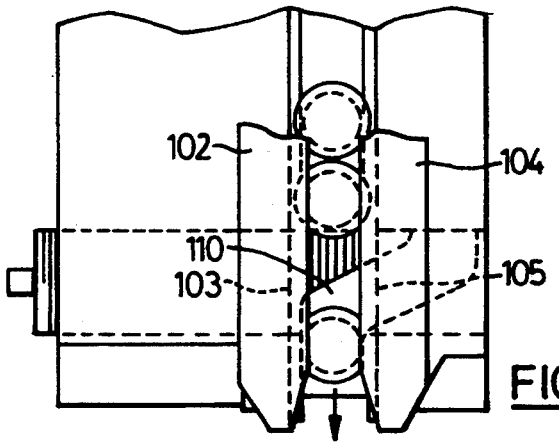

In FIG. 14*b*, the block 108 has moved to the left hand limit of its travel. In this position the vent blank skirt 14 of the lowermost vent blank (above block 108) may enter slot 110 as shown. The block 108 then moves to the right. In such movement the skirt moves downward in the block slot 110 while being restricted against lateral movement since edges 103, 105 limit lateral movement of the edges of flange 10. Thus when the block 108 has again reached the right hand end of its travel as shown in FIG. 14*d* the sjirt has reached the lower end of slot 110 and falls toward the vent fingers, as best shown in FIG. 4. The vent fingers are provided with sloping surfaces 112 and sloping surfaces are provided (not shown) on the aperture defining edges of the block, which are opposing in a direction perpendicular to the fingers, to guide the vent blank into its proper position as shown in FIGS. 8 and 4.

Figure 11:
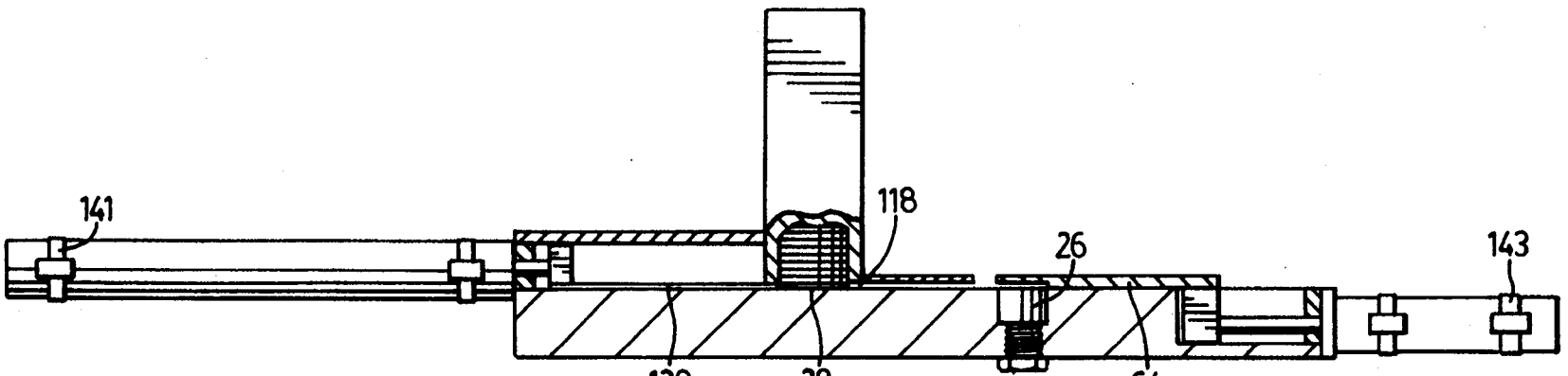
FIGS. 11,12 and 13 show the means for positioning and sensing
Figure 12:
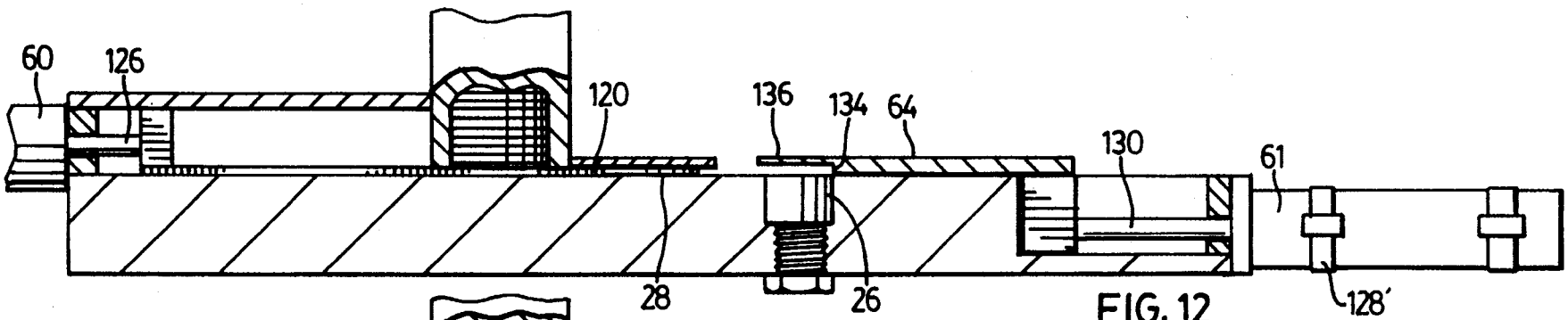
Figure 13:
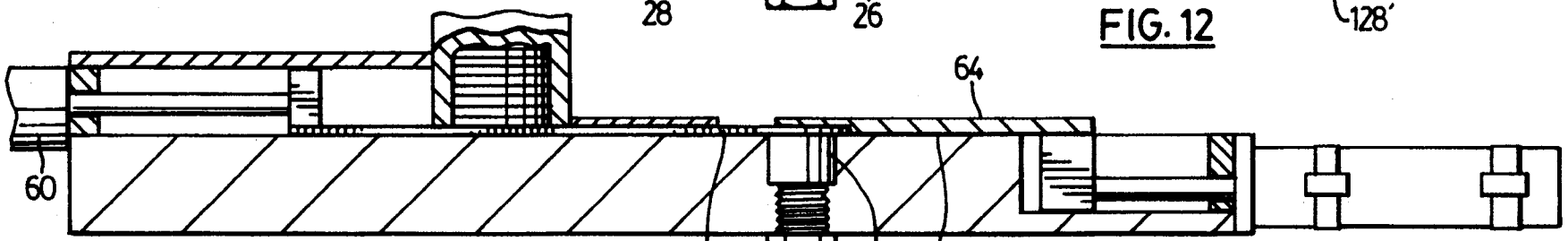

If a washer is used then reference may be had to FIGS. 10, 1, and 11–13. Rearward of the intended vertical location of sleeve 44 and die 26, the table provides tube 114 designed to support a stack of horizontally oriented washers 28. The tube 114 is provided with an rearwardly facing slot in which may be received a notched pusher plate. The height of the plate and of the pusher plate are approximately that of the thickness of a washer 28. An exit slot 118 for the lowest washer in the stack is provided radially directed toward the location of die 26. A guide plate 121 located on table surface 30 defines a guide slot 122 radially directed toward die 26 and stopping a short distance rearwardly thereof. A piston 60 operates rod 126 to reciprocate a notched plate 120 between a position where notch 128 is just rearward of the lowest, in the stack, washer 26, and a position where it has advanced such washer to be concentric with die 26 (whose upper surface is flush with table surface 30, as best shown in FIGS. 11–13).

Facing the path of a washer under control of plate 120 is pusher plate 64. Plate 64 is moveable under the control of piston rod 130, operable by cylinder 61. A sensor 128' which is preferably magnetic but may be of any other conventional type is located on cylinder 61 to sense the presence of the piston (not shown) in cylinder 61 at the location which washer 28 is concentric with die 26. The axis of movement of plate 64 is coaxial with the axis of movement of plate 120. The rearwardly facing end of plate 64 is provided with a rearwardly facing recess 134 shaped to receive edge or a washer 28 and provides an overhang 136 adapted to keep the washer level. Before actuation, the plate 64 is located in a position advanced about ⅛" toward plate 120 from the position where contained in its recess 134, 136 a washer 28 would be concentric with die 26. Thus plates 120 and 64 are located as shown in FIG. 11. When it is desired to install a washer over die 26 the controller 11 actuates plate 120 to advance so that notch 128 moves the lowest washer 28 out of the stack and moves it toward plate 120. The moving washer then enters recess 134, 136 and moves plate 64 to the right overcoming the (designed) lesser thrust of piston 61 until the washer is concentric with die 26. Sensor 128' detects the position of its associated piston when the washer is concentric with the die. (Piston 61 is still urged toward the left (in FIGS. 11–13) but piston 60 is designed to exert a slightly greater force towards the right) in FIGS. 11–13. Thus, the washer is moved to concentric position with die 26 and the achievement of this position is signalled by sensor 128'. The sensor 128' then signals the controller 11 that the washer is in concentric position and it is held in this position between notch 128 and recess 134 until the skirt 14, 20 passes through the washer aperture and curls to clamp it to fabric 22 and flange 10. (The plates 120 and 64 hold the washer 26 in position because piston 60 trying to advance plate 120 to the right, (although stronger than piston 61) is at its right hand limit of movement). FIGS. 6A shows the relative positions of washer 26, die 28, fabric 22 and flange 10 at the time of this clamping.

After installation of the vent pistons 60 and 61 withdraw plates 120 and 64 to allow movement of the fabric. Sensors 141,143 signal such withdrawal to controller 11.

The operation of the device is as follows:

A) Before operation the punch rod 46 is retracted relative to the sleeve 44, so the lower surfaces of these members are flush. The cylinder 42 and hence sleeve 44 are in their upper position (see LM and RM in FIG. 1 and RM in FIG. 2). The vent block 52 is in its upper position (RM in FIG. 1). (See FIG. 15-1)

B) The strip 38 of fabric to which the vent is to be applied is located in place on table surface 30 beneath vent block 52. (FIG. 1 LHS). There is no vent blank on fingers 70.

C) The controller 11 signals, by means not shown, for the initiation of the punching operation. Under control of the controller 11 the cylinder 40 is operated to lower cylinder 42, sleeve 44 and retracted punch rod 46, together, to lower position where sleeve 44 clamps fabric 22 to table 32. (FIG. 15-2) (The fingers 70 are deflected by the passage of the sleeve). With these members positioned, the controller causes activation of the punch rod 46 to move downward to its extended position, as shown in FIG. 3. In such downward movement, the punch rod 36 severs the fabric to detach scrap 22P in combination with edges 86 of die 26 to form the aperture in the fabric all as shown in FIG. 3. (See FIG. 15-3).

Figures 1, 2, 3, 4, 5, 6, 7, 8, 15:
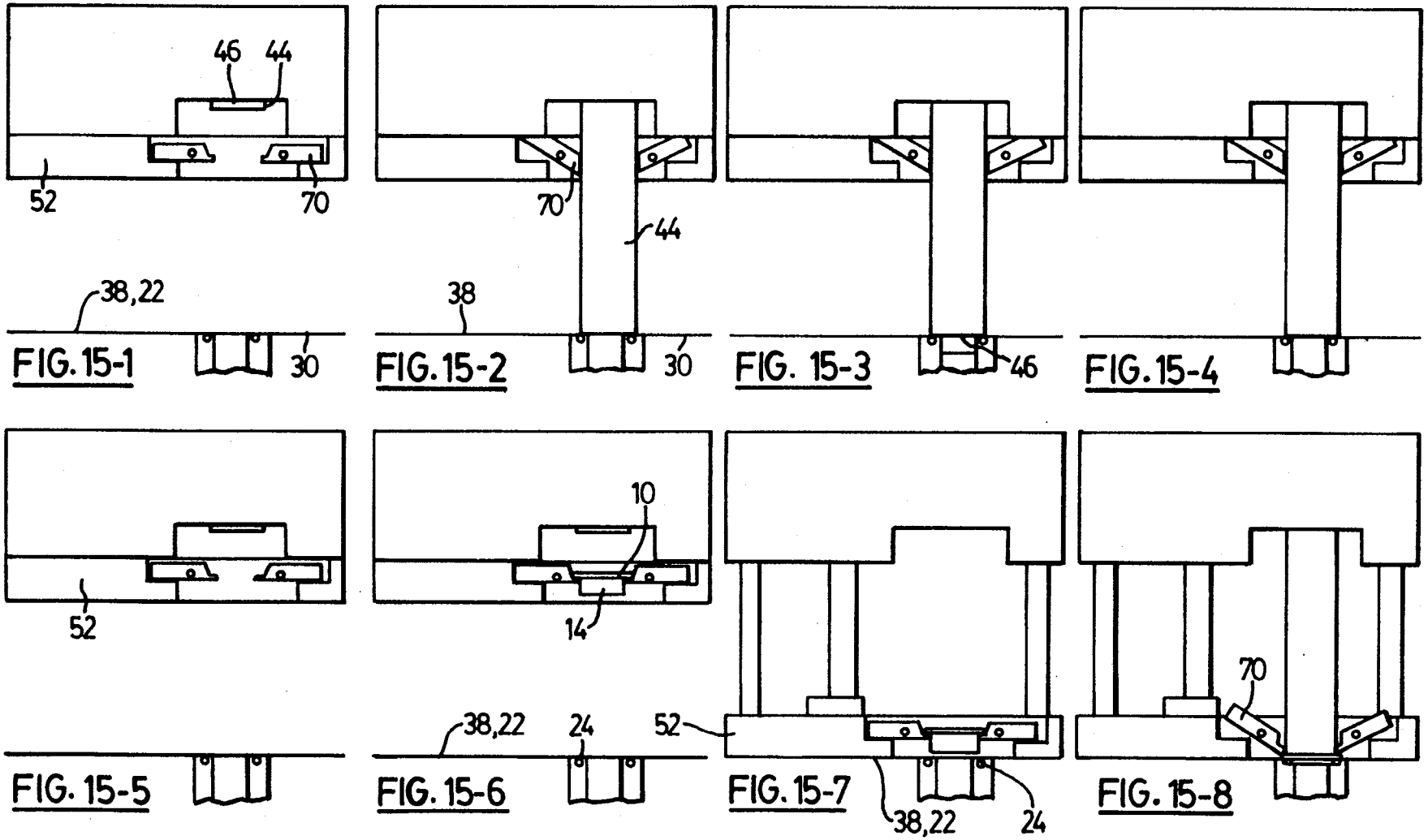

D) After the punching operation is completed the punch rod is retracted so that its lower surface is flush with the lower surface of sleeve 44. (FIG. 15-4). The cylinder 40 is then operated to return the sleeve, punch rod and cylinder 42 to their upper position as shown in FIG. 1 machine RM and in FIGS. 2, machine RM. The vent positioner mount is also operated to raise the vent block to upper position, also as shown in FIG. 1 machine RM. (FIG. 15-5).

E) With the vent block in its upper position, the controller causes the vent meter to complete one metering cycle (FIGS. 14A–14D) to cause one vent blank to be released from the chute to slide into position on fingers 70 (FIGS. 4 and 9) (FIG. 15-6). The beam-sensor pairs 90-94 and 92-96 are activated to determine whether the vent blank is in its proper attitude. If not, as with the blank in FIG. 7, the sensors report to the controller and the operation is interrupted until a vent is correctly positioned on the fingers so that the sensors report the situation in FIG. 8. When a vent is correctly positioned on the fingers 70, as shown in FIG. 8 (either as a result of correctional measures after an incorrect positioning or as a result of correct positioning the first time,) the beam sensor pairs 90-94 and 92-96 report the correct alignment to the controller 11.

F) If a washer is to be used then piston 60 is activated to advance and push out the lowest washer 28 in the stack into position, past, and then with piston 64 back to position concentric with the die, FIGS. 9, 10, 11, 12, 13. When the washer 28 is located concentric with die 26 (FIG. 6A) a sensor associated with piston 61 signals the controller.

G) When the controller receives the signal that the vent blank is correctly positioned on fingers 70 (and if a washer is being used that the washer is concentrically positioned over die 26) then the controller will cause the vent blank mount 48 to lower the vent block assembly 52, now carrying a vent blank, to the vicinity of the fabric 22. (FIG. 15-7)

The controller will then activate piston 40 to lower piston 42, sleeve 44 and retracted punch rod 46 until sleeve 44 contacts the vent blank in its downward passage and carries the vent blank with it, beginning the deflection of fingers 70 (FIG. 5) (FIG. 15-8). The downward movement of sleeve and blank and deflection of fingers 70 continues. The lower edge 20 of the vent blank pushes aside edges 88 of the fabric or cuts a small ring to enlarge the hole, and encounters groove 24 and is curled outward and upward to clamp the fabric against the vent flange if no washer is used, (FIG. 6) or the washer and fabric against the vent flange (FIG. 6A), if a washer is used.

H) After the clamping is completed, the sleeve 44 and retracted punch rod 46 are moved with piston 42 to their upper position and the vent block is raised to its upper position. The fingers 70 return to their level bias position. (FIG. 15-1). The fabric may then be moved to locate the next downward position for a vent over the die and the machine is ready for another cycle. This is the preferred method of operation.

In what is a simple but less satisfactory method the prepunching of the hole is omitted. The combined punch rod and sleeve are replaced by a unitary pusher rod. Steps A-D are omitted and the apparatus starts at FIG. 15-5 with the vent blank being positioned step E and FIG. 15-6. The process of steps F-H, FIGS. 15-6 to 15-8 occur where the functions of the sleeve are performed by a pusher rod of similar outside dimensions. With this alternative there is more chance of malfunction and the fabric punched out by the skirt is caught in the centre of the vent and must be removed in a separate operation.

What is claimed is:

1. Means for applying a vent to a fabric, utilizing a vent skirt extending downwardly from a flange surrounding vent apertures, said skirt having a lower edge, a frame, a fabric support surface, an aperture therein, a die in registration with said aperture, said die having a surface located just below said fabric, a bore in said die extending transverse to said fabric support surface, a groove in said die surface and surrounding said bore and shaped to curl outwardly and upwardly the descending edges of a vent skirt, a sleeve having upper, and lower, positions relative to said frame, having a lower face substantially parallel to the fabric, a punch rod in said sleeve movable between retracted position and an advanced position, relative to said sleeve, and located at or above said lower face in retracted position, vent positioner assembly, having upper and lower positions, said assembly defining an aperture designed to allow passage along a downward vertical path of a vent with a horizontally oriented flange, a pair of opposed fingers each having a rest position and a deflected position, and biased toward said rest position, in said rest position, designed to support a vent blank above said fabric with the flange approximately parallel thereto with a skirt edge vertically aligned with said groove, said fingers in said deflected position being spaced to allow passage of said vent, downwardly through said assembly aperture, means, when said assembly is in said upper position for providing a vent for support on said fingers, means for sensing the correct alignment of said vent on said fingers, means when fabric is present of said support surface for:

punching a hole in said fabric with said punch rod, thereafter retracting said punch rod, placing said sleeve and said assembly in upper position, means for locating a correctly oriented vent on said fingers, means, responsive to the sensing of the presence of said vent for causing the descent of the assembly, with vent in place, to clamping position, means responsive to the assembly with vent reaching clamping position, to cause said sleeve (and punch rod) to descend together to cause curling of said skirt in said die groove.

2. In means for applying a vent to a fabric, including means for punching a hole in said fabric, means for positioning a vent blank which vent blank includes: at east one air passage, a flange and a skirt extending downward from said flange, about said aperture, pivotable finger means for supporting said vent blank by the flange prior to application, with said flange in an attitude approximately parallel to said fabric, and means for applying said vent to said fabric while curling the lower edges of said skirt to clamp said fabric, between said edges and said flange.

3. Means for applying a vent to a fabric including:

means for supporting a fabric, means for punching a hole in said fabric, a vent positioner assembly for supporting a vent blank over said fabric, wherein said vent blank comprises a central aperture, a flange adapted to be supported generally parallel to said fabric, and a skirt having lower edges surrounding said aperture, and extending generally perpendicular to said flange, means for applying said vent blank to said fabric, about said hole and curling said skirt outwardly, to crimp fabric surrounding said aperture, against said flange, wherein:

said vent positioner assembly comprises:

a block, an aperture through said block directed toward said fabric, defining a path for movement of said vent blank toward said fabric, a pair of opposed fingers projecting into said aperture, each finger having a rest position and a deflected position and being biased toward rest position, in said rest position being adapted to support said vent blank in said attitude and in said blank there through, towards said fabric.

4. Means for applying a vent to a fabric as claimed in claim 3, wherein sensing means are provided adapted to provide one or another set of signal respectively dependant upon whether or not said vent blank is in the correct attitude in said assembly.

5. Means for applying a vent to a fabric as claimed in claim 4, wherein said sensing means comprises:

a first sensing path, defined by a beam emitter and a sensor, located to: be interrupted or be clear of said path, when said blank is present on or absent from said support, respectively, a second sensing path, defined by a beam and an emitter, located to be; clear or interrupted, respectively, when said blank is supported in correct or incorrect attitude on said supports.

6. Means as claimed in claim 2 where said curling is caused by a die.

7. Means for applying a vent to a fabric, where said vent is to be formed from a vent blank having at least one air passage, a flange surrounding such aperture and a skirt surrounding such aperture and extending generally downward from said flange, means responsive to downward movement of said blank to curl the lower portion of said skirt outwardly and upwardly to crimp fabric to said flange, means for supporting said fabric, means for punching in said fabric, an aperture slightly smaller than said skirt, pivotable finger means for supporting said blank by the flange above said fabric with said skirt directed generally toward said hole, means for moving said blank downward so that said skirt edge passes through said fabric and is curled to crimp said fabric to the flange.

8. Means for applying a vent to a fabric, as claimed in claim 7, including sensing means for determining whether said blank is supported in the correct attitude and responsive to said determination to initiate operation of said means for moving said blank downward.

9. Means for applying a vent to a fabric, as claimed in claim 8 where said sensing means comprises:

a first sensing path, defined by a beam emitter and a sensor located to be: clear or interrupted, respectively, when said blank in supported in correct and incorrect attitude, on said supports.

10. Means for applying a vent to a fabric as claimed in claim 1, including, means operable before the descent of said assembly to position a washer concentric with said aperture in washer aperture having a diameter intermediate the outer and inner diameters of the groove in said die, whereby on descent of said assembly, said skirt will pass through the aperture in said washer and have its edges curled outwardly and upwardly to clamp said washer against said fabric and, in turn, said flange.

11. Means for applying a vent to a fabric as claimed in claim 10, including means for sensing the correct positioning of said washer, and wherein said means for causing the descent of the assembly is responsive to the sensing of the correct positioning of said washer as well as the correct positioning of said vent for causing such descent.

12. Means for applying a vent to a fabric as claimed in claim 11 where said washer is positioned by means for advancing said washer edgewise past desired position to deflect a second means located to be moved by said washer as it moves edgewise toward correct position and there is means for sensing and signalling when the movement of such stop is such that said washer is correctly positioned.

13. Means for applying a vent to a fabric as claimed in claim 7 including means for positioning a washer below said fabric, concentric with said fabric hole said washer having an aperture diameter greater than that of said skirt before curling and less than that of the skirt edges after curling.

whereby on descent of said assembly, said skirt will pass through the aperture in said washer and have its edges curled outwardly and upwardly to clamp said washer against said fabric and, in turn, the washer against said flange.

14. Means for applying a vent to fabric as claimed in claim 13 wherein said washer is positioned by means for advancing said washer edgewise into position and wherein a yieldable stop is located to be moved by said washer as it moves edgewise past correct position and return means for causing said yieldable stop to move said washer back to correct position and there is means for sensing and signalling when said washer is correctly positioned.

15. Means for applying a vent to fabric as claimed in claim 14 wherein said return means causes retraction of said advance means, and said last-mentioned sensing means is adapted to sense the amount of said retraction.

16. Means for applying a vent to a fabric, utilizing a vent skirt extending downwardly from a flange surrounding a vent aperture, said skirt having a lower edge, a frame, a fabric support surface, an aperture therein, a die in registration with said aperture, said die having a surface located just below said fabric, a groove in said die surface and surrounding said bore and shaped to curl outwardly and upwardly the descending edges of a vent skirt, a push rod having upper, and lower positions relative to said frame, having a lower face parallel to the fabric, vent positioner assembly, having upper and lower positions, said assembly defining an aperture designed to allow passage along a downward vertical path of a vent with a horizontally oriented flange, a pair of opposed fingers each having a rest position and a deflected position, and biased toward said rest position, in said rest position, designed to support a vent blank above said fabric with the flange approximately parallel thereto with a skirt edges vertically aligned with said groove, said fingers in said deflected position being spaced to allow passage of said vent, downwardly through said assembly aperture, means, when said assembly is in said upper position for providing a vent for support on said fingers, means for sensing the correct alignment of said vent on said fingers, means, when said vent positioner is in the upper position, for locating a correctly oriented vent on said fingers, means, responsive to the sensing of the presence of said vent for causing the descent of the assembly, with vent in place, to lower position and, means responsive to the assembly with vent reaching lower position, to cause said push rod to descend together to cause curling of said skirt in said die groove.

17. In means for applying a vent to a fabric, means for positioning a vent blank which vent blank includes:

at least one air passage, a flange and a skirt extending downwardly from said flange, about said aperture, pivotable finger means for supporting said vent blank by the flange prior to application, with said flange in an attitude approximately parallel to said fabric, and means for applying said vent to said fabric by causing passage of said skirt therethrough, and thereafter curling the lower edges of said skirt into clinching engagement with said fabric, and said flange.

18. In means as claimed in claim 17 wherein sensing means indicates when said flange is supported in said attitude.

19. Means for applying a vent to a fabric including:

means for supporting a fabric, a vent positioner assembly for supporting a vent blank over said fabric, wherein said vent blank comprises a central aperture, a flange adapted to be supported generally parallel to said fabric, and a skirt having lower edges surrounding said aperture, and extending generally perpendicular to said flange, means for applying said vent blank to said fabric, by passing said edges through said fabric and curling said skirt adjacent said edges outwardly to crimp fabric surrounding said aperture, against said flange, wherein:

said vent positioner assembly comprises:

a block, an aperture through said block directed toward said fabric, defining a path for movement of said vent blank toward said fabric, a pair of opposed fingers projecting into said aperture, each finger having a rest position and a deflected position and being biased toward rest position and, in said rest position being adapted to support said vent blank in said attitude and in said deflected position adapted to allow passage of said blank therethrough, towards said fabric.

20. Means for applying a vent to a fabric as claimed in claim 16 wherein said sensing means comprises:

a first sensing path, defined by a beam emitter and a sensor, located to: be interrupted or be clear of said path, when said blank is present on or absent from said support, respectively and, a second sensing path, defined by a beam and an emitter, located to be: clear or interrupted, respectively, when said blank is supported in correct or incorrect attitude on said supports.

21. Means as claimed in claim 2 wherein sensing means indicates when said flange is supported in said attitude.

* * * * *